US006144282A

United States Patent [19]

Lee

[11] Patent Number: 6,144,282

[45] Date of Patent: Nov. 7, 2000

[54] HIGH VOLTAGE TRANSFORMER AND METHOD OF MAKING A HIGH VOLTAGE TRANSFORMER HAVING RADIATING RIBS

[76] Inventor: Chea-how Lee, 403-205, Jukong Apartment, Cheongmyoung-maeul, Youngtong-dong, Paldal-gu, Suwon-city, Kyungki-do, Rep. of Korea

[21] Appl. No.: 09/388,531

[22] Filed: Sep. 2, 1999

[30] Foreign Application Priority Data

May 27, 1999 [KR] Rep. of Korea ..... 99/19131

[51] Int. Cl.[7] ..... H01F 27/28; H01F 27/10

[52] U.S. Cl. ..... 336/234; 336/217; 336/55; 336/61

[58] Field of Search ..... 336/234, 221, 336/55, 61, 217

[56] References Cited

U.S. PATENT DOCUMENTS 5,954,988 9/1999 Lee .

FOREIGN PATENT DOCUMENTS 99-71294 9/1999 Rep. of Korea .
914857 1/1963 United Kingdom .
1455-398 11/1976 United Kingdom ..... 336/61

*Primary Examiner*—Michael L. Gellner
*Assistant Examiner*—Anh Mai

[57] ABSTRACT

A high voltage transformer having radiation ribs has a laminated core formed of a plurality of accumulated iron plates, first and second windings wound in the laminated core for converting an input voltage to a predetermined output voltage, and a plurality of radiation ribs formed in the accumulated direction of the plurality of iron plates on the outer periphery of the laminated core. The plurality of radiation ribs are formed as the plurality of iron plates are accumulated, by the accumulation of a plurality of protrusion portions formed along each of the plurality of iron plates. Since the radiation ribs are formed on the outer periphery and in the accumulated direction of the laminated core, all the iron plates constituting the laminated core have the same shape and are disposed in the same direction.

16 Claims, 3 Drawing Sheets

HIGH VOLTAGE TRANSFORMER AND METHOD OF MAKING A HIGH VOLTAGE TRANSFORMER HAVING RADIATING RIBS

CLAIM OF PRIORITY

This application makes reference to, incorporates the same herein, and claims all benefits accruing under 35 U.S.C. §119 from an application entitled HIGH VOLTAGE TRANSFORMER HAVING RADIATING RIBS earlier filed in the Korean Industrial Property Office on May 27, 1999, and there duly assigned Ser. No. 19131/1999.

BACKGROUND OF THE INVENTION

1. Field of the Invention

The present invention relates to a high voltage transformer for generating a high voltage from an input commercial voltage and supplying the high voltage to a component which requires the high voltage.

2. Description of the Prior Art

In general, a high voltage transformer(HVT) is a device for inputting voltages from 110 volts to 220 volts to generate a higher voltage, and is used for electronic appliances such as a general microwave oven having components which require a higher voltage for operation.

Such a high voltage transformer has a laminated core which is formed of a plurality of iron plates that are piled up one over another, and first and second windings wound over the laminated core. One iron plate has, in general, the shape of an E-shaped iron plate and an I-shaped iron plate which are joined to each other. If an alternate current (AC) voltage is input to the first winding, a voltage is induced in the second winding by an electromagnetic induction operation. The induced voltage is determined by the turns ratio of the first and second windings.

In the meantime, the high voltage transformer generates heat by a Joule loss according to coil resistance, a hysteresis core loss, and a vortex current loss. Since such generated heat causes a problem such as degradation of an insulation part, it is desirable to properly radiate the generated heat.

Accordingly, a device is mounted on the high voltage transformer to radiate the generated heat. For example, a high voltage transformer disclosed in the Republic of Korea Patent Application No. 98-6654, published as Korea Patent Publication No. 99-71294 which has been already applied for by the same applicant of the present invention, has radiation pins 3 at predetermined intervals between a plurality of iron plates 1*a* which form a laminated core 1 as shown in FIG. 1, so that generated heat is radiated through the radiation pins 3.

Further, Great Britain Patent No. 914,857 granted to the General Electric Co., as shown in FIG. 2, shows that two adjacent legs of E-shaped iron plates 4 have different widths, and the E-shaped iron plates 4 are alternately accumulated. According to this, structure legs 4*a* of a wider width of the E-shaped iron plates 4 are protruded to both sides of the laminated core to form radiation ribs 5.

However, in the conventional high voltage transformers as presented above, there is a drawback to an assembly efficiency in that the manufacturing process of such transformers becomes complicated and requires a lot of time, since a radiation pin is inserted between iron plates when a laminated core is formed, or since iron plates are alternately arranged in a different direction to each other.

SUMMARY OF THE INVENTION

It is an object of the present invention to provide a high voltage transformer having an excellent assembly efficiency as well as an excellent radiation efficiency.

In order to achieve the above object, a high voltage transformer according to the present invention includes a laminated core formed of a plurality of iron plates which are accumulated one over another; first and second windings wound in the laminated core and for converting an input voltage to a predetermined output voltage; and a plurality of radiation ribs formed in the accumulated direction of the plurality of iron plates on the outer periphery of the laminated core.

Each iron plate has a plurality of protrusion portions along the outer periphery. Therefore, the plurality of radiation ribs are formed as the plurality of iron plates are accumulated. Further, it is desirable that each radiation rib has a rectangular-shaped cross section in order for the surface area to be maximized.

According to such embodiments, since the radiation ribs are formed in an accumulated direction of the iron plates on the outer periphery of the laminated core, all the iron plates structuring the laminated core are in the same shape and are accumulated in the same direction.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
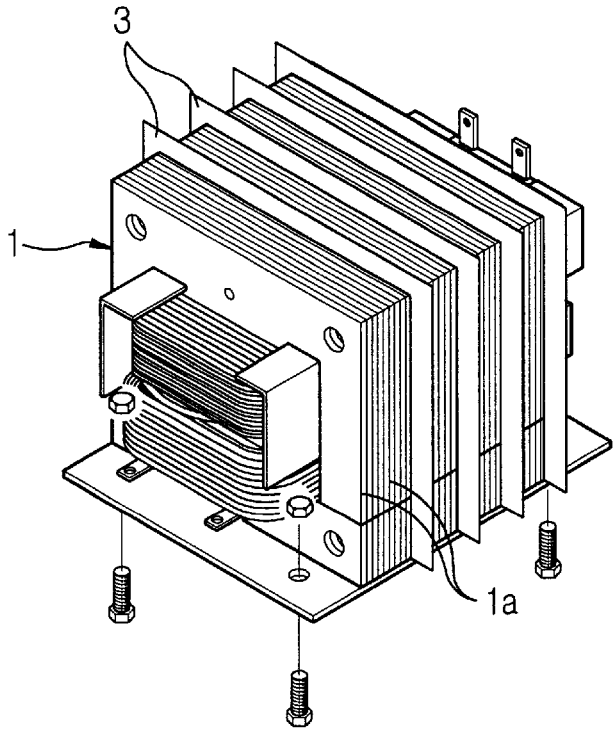
FIG. 1 (PRIOR ART)
FIG. 1 is a perspective view of an example of a conventional high voltage transformer.
Figure 2:
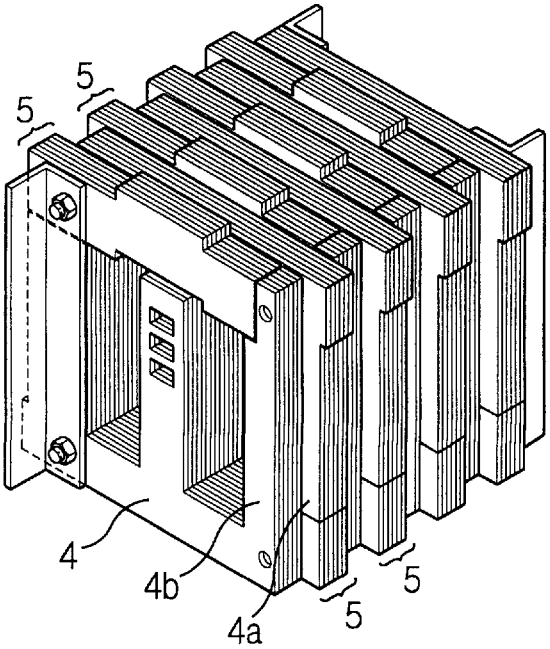
FIG. 2 (PRIOR ART)
FIG. 2 is a perspective view of another example of a conventional high voltage transformer.
Figure 3:
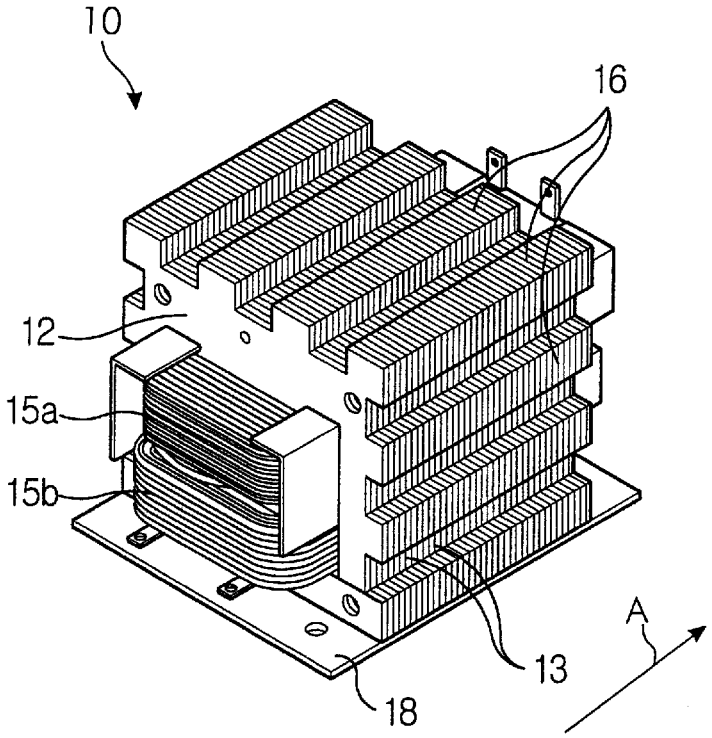
FIG. 3 is a perspective view of a high voltage transformer according to an embodiment of the present invention.
Figure 4:
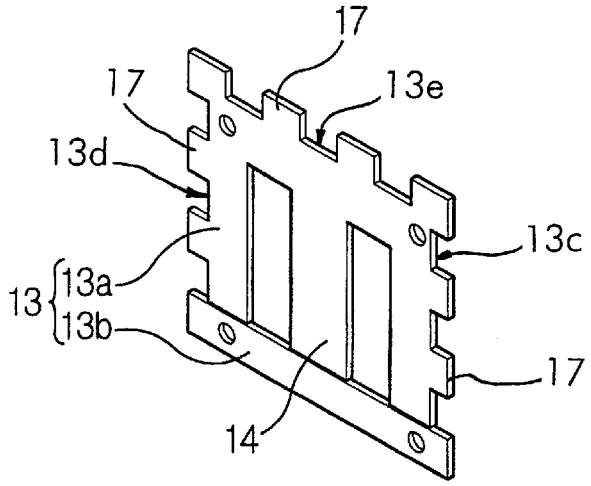
FIG. 4 is a perspective view for showing an iron plate constituting a laminated core of the high voltage transformer of FIG. 3 according to an embodiment of the present invention.

A high voltage transformer according to an embodiment of the present invention is shown in FIGS. 3 and 4. FIG. 3 is a perspective view of the high voltage transformer according to an embodiment of the present invention, and FIG. 4 is a perspective view of an iron plate constituting a laminated core of the high voltage transformer according to an embodiment of the present invention.

As shown in FIGS. 3 and 4, the high voltage transformer 10 according to an embodiment of the present invention includes a laminated core 12, first and second windings 15*a* and 15*b*, and a plurality of radiation ribs 16.

The laminated core 12, as shown in FIG. 4, is formed by accumulating a plurality of iron plates 13 each of which has the shape of an E-shaped member 13*a* joined with an I-shaped member 13*b*. The first and second windings 15*a* and 15*b* are inserted around a middle leg 14 of the E-shaped member 13*a*, and convert an input AC voltage into an output voltage.

Figure 5:
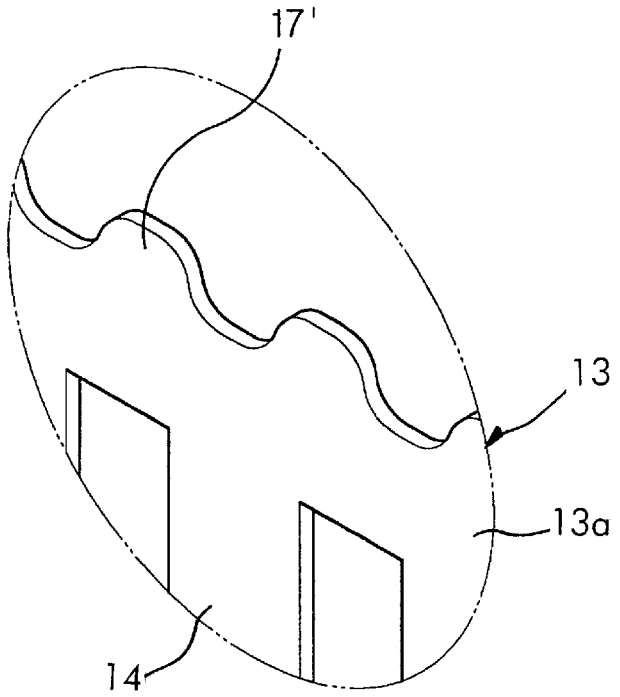
FIGS. 5 and 6 are perspective views of main portions of radiation ribs of the high voltage transformer according to another embodiments of the present invention, respectively.
Figure 6:
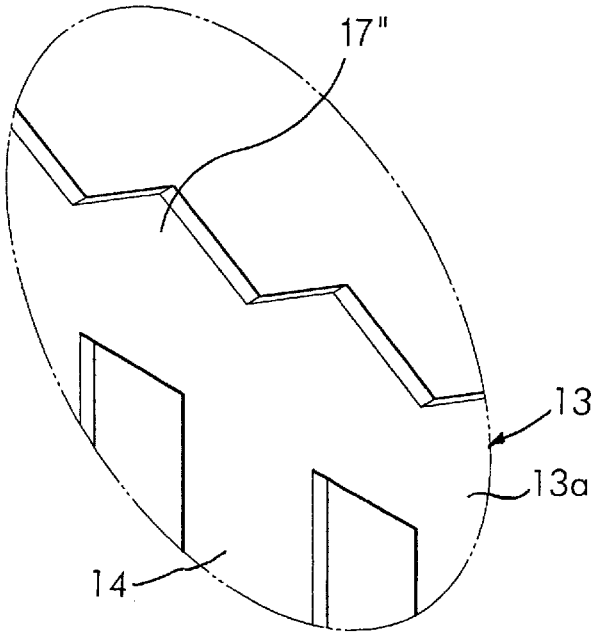

The main portion of the present invention, i.e., the radiation ribs 16 are formed in the accumulated direction A of the iron plates 13 on both sides 13*c*, 13*d* and the upper side 13*e* of each of the iron plates 13. As shown in FIG. 4 in greater detail, respective radiation ribs 16 are formed as the iron plates 13 are accumulated, by the accumulation of the plurality of protrusion portions 17 which are formed along the outer peripheries of E-shaped members 13*a* of the iron plates 13, respectively. The cross section of each of the radiation ribs 16, that is, the shape of each of the protrusion portions 17, is not limited to the rectangular shape as shown in FIGS. 3 and 4, but can be formed in different shapes, such as a wave shape 17' or a triangular shape 17", which are respectively shown in FIGS. 5 and 6. However, since a wider surface area of the laminated core 12 is more advantageous in radiating heat generated in a high voltage transformer, the radiation ribs 16 are more desirably formed in a rectangular shape, such as shown in FIGS. 3 and 4, for a maximum surface area of the protrusion portion.

Further, referring to FIG. 3, reference numeral 18 denotes a base plate for supporting the high voltage transformer 10 and at the same time, for fixing the high voltage transformer 10 to another member.

The high voltage transformer 10 according to an embodiment of the present invention as structured above is formed by accumulating iron plates 13. Since the radiation ribs 16 are formed in the accumulated direction A of the laminated core 12, accumulated iron plates 13 have the same shape as shown in the embodiment of FIG. 4, as well as the embodiments of FIGS. 5 and 6. Accordingly, in the laminated core 12 of the high voltage transformer 10 according to an embodiment of the present invention, there is no need to insert radiation pin members of a different size between accumulated iron plates, as in a conventional transformer, or to dispose the iron plates alternately with respect to each other. The E-shaped member 13*a* and the I-shaped member 13*b* which constitute each of iron plates 13, are respectively accumulated. The first and second windings 15*a*, 15*b* are wound over the middle leg 14 of the E-shaped member 13*a* and then electrically connected to each other, such electrical connection being obvious to one skilled in this field.

According to the present invention as above, since the radiation ribs are formed in the accumulated direction of iron plates on the outer periphery of the laminated core, all the iron plates constituting the laminated core have the same shape and are arranged in the same direction. Accordingly, in the present invention since the accumulating work becomes very simple and can be rapidly performed, the assembly efficiency is greatly increased when manufacturing the laminated core.

Further, in the laminated core of the high voltage transformer according to the present invention, since the radiation ribs are uniformly formed on the outer periphery, i.e., the three sides of the laminated core, and can have a shape of a maximum surface area, the radiation efficiency can be greatly increased.

As stated above, preferred embodiments of the present invention are shown and described. Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A high voltage transformer, comprising:

a laminated core formed of a plurality of iron plates which are accumulated to form the laminated core;

a first winding and a second winding provided in the laminated core for converting an input voltage to a predetermined output voltage; and a plurality of radiation ribs having a plurality of protrusion portions, each of the plurality of protrusion portions being respectively integrally formed of the laminated core.

2. The high voltage transformer as claimed in claim 1, further comprised of each of the plurality of protrusion portions has a cross section of a rectangular shape in order for a surface area of each protrusion portion of the plurality of protrusion portions to be maximized.

3. The high voltage transformer as claimed in claim 2, further comprised of each of the plurality of iron plates has a same shape.

4. The high voltage transformer as claimed in claim 1, further comprised of each of the plurality of protrusion portions has a cross section of a wave shape in order for a surface area of each protrusion portion of the plurality of protrusion portions to be maximized.

5. The high voltage transformer as claimed in claim 4, further comprised of each of the plurality of iron plates has a same shape.

6. The high voltage transformer as claimed in claim 1, further comprised of each of the plurality of iron plates has a same shape.

7. The high voltage transformer as claimed in claim 1, further comprised of each of the plurality of protrusion portions has a cross section of a triangular shape in order for a surface area of each protrusion portion of the plurality of protrusion portions to be maximized.

8. The high voltage transformer as claimed in claim 7, further comprised of each of the plurality of iron plates has a same shape.

9. A method of making a high voltage transformer, comprising the steps of:

forming a laminated core by accumulating a plurality of iron plates;

providing a first winding and a second winding in the laminated core for converting an input voltage to a predetermined output voltage; and providing a plurality of radiation ribs by integrally forming a plurality of protrusion portions respectively on an outer periphery of each of the plurality of iron plates of the laminated core.

10. The method as claimed in claim 9, further comprised of forming each of the plurality of protrusion portions to have a cross section of a rectangular shape to maximize a surface area of each protrusion portion of the plurality of protrusion portions.

11. The method as claimed in claim 10, further comprised of providing each of the plurality of iron plates to have a same shape.

12. The method as claimed in claim 9, further comprised of forming each of the plurality of protrusion portions to have a cross section of a wave shape to maximize a surface area of each protrusion portion of the plurality of protrusion portions.

13. The method as claimed in claim 12, further comprised of providing each of the plurality of iron plates to have a same shape.

14. The method as claimed in claim 9, further comprised of providing each of the plurality of iron plates to have a same shape.

15. The method as claimed in claim 9, further comprised of forming each of the plurality of protrusion portions to have a cross section of a triangular shape to maximize a surface area of each protrusion portion of the plurality of protrusion portions.

16. The method as claimed in claim 15, further comprised of providing each of the plurality of iron plates to have a same shape.

* * * * *